United States Patent [19]

Block

[11] Patent Number: 4,717,353

[45] Date of Patent: Jan. 5, 1988

[54] DOCKING HEAD AND PLATE

[75] Inventor: Forest E. Block, Rockford, Ill.

[73] Assignee: McDermott Incorporated, New Orleans, La.

[21] Appl. No.: 5,721

[22] Filed: Jan. 21, 1987

[51] Int. Cl.[4] ..... H01R 13/629

[52] U.S. Cl. ..... 439/310

[58] Field of Search ..... 339/75 R, 75 M, 34, 339/35, 65, 92 R, 92 M; 439/296, 310, 359, 362–365

[56] References Cited

U.S. PATENT DOCUMENTS

| | | | |
|---|---|---|---|
| 2,700,141 | 1/1955 | Jones | 339/34 |
| 2,703,870 | 3/1955 | Minto | 339/34 |
| 3,345,604 | 10/1967 | Henschen et al. | 339/75 M |
| 3,368,040 | 2/1968 | Bryan | 339/34 |
| 3,635,184 | 1/1972 | Liautaud | 339/75 M |
| 4,483,575 | 11/1984 | Kruger et al. | 339/92 M |
| 4,630,878 | 12/1986 | Heine et al. | 339/75 M |

*Primary Examiner*—John McQuade

*Attorney, Agent, or Firm*—Robert J. Edwards; D. Neil LaHaye

[57] ABSTRACT

A docking head and plate assembly suitable for supplying services to pipeline laying equipment. A docking head which supplies services to welding and other equipment inside the pipeline has service connections attached to a bushing plate assembly which causes the service connections to engage or disengage with corresponding connections in a docking plate which is aligned adjacent the docking head and locked in position while the service connections are engaged. A drive assembly in the docking plate engages the bushing plate assembly to cause movement of the bushing plate assembly and service connections.

13 Claims, 6 Drawing Figures

DOCKING HEAD AND PLATE

BACKGROUND OF THE INVENTION

1. Field of the Invention

The present invention relates to connectors and in particular to a multiple connector assembly providing electrical and hydraulic services to a welding system.

2. General Background

In certain operation such as laying of pipeline on land or offshore, it is necessary that welding of new pipe sections to the pipeline, removal of flash from the fresh weld, and addition of any new pipe sections be accomplished in a continuous moving operation to assure that equipment and manpower are used in the most efficient manner possible. A time consuming step in this process is the addition of new pipe sections, especially in flash butt welding where the equipment used for welding and removal of flash on the inside of the pipe are positioned on the inside of the pipeline. This is time consuming as addition of a new pipe section cannot be done until all electrical and hydraulic power sources to the equipment positioned inside the pipeline have been disconnected. Once the new pipe section is in position, all power supplies must be reconnected. Disconnection and reconnection of these electrical and hydraulic lines has traditionally been accomplished by workers using hand tools to manually disconnect and reconnect each service line. This has been found to be inefficient since as many as eight separate connections may be involved. It can thus beeen seen that there exists a need for a more efficient method of disconnecting and connecting these lines so that the time required for adding a new pipe section and beginning welding of the new section to the pipeline is minimized.

SUMMARY OF THE INVENTION

The present invention solves the above problem by providing a docking head and plate which may be quickly engaged and disengaged for providing electrical and hydraulic services to the welding and accessory equipment. The docking head is the portion of equipment that fits inside the new pipe section being added to the pipeline and is similar to known equipment from the standpoint that the electrical and hydraulic services received by the connections in the docking head direct the services via appropriate lines to equipment positioned further inside the new pipe section and pipeline. The electrical and hydraulic connections in the docking head are attached to a bushing plate. A screw drive in the docking head has the bushing plate mounted thereon such that rotation of the screw drive causes movement of the bushing plate and connections out of the docking head and into engagement with opposing connections in the docking plate or out of engagement with the opposing connections and back into the docking head. An interlock system is provided to prevent accidental lifting of the docking plate while the connections in the docking head and plate are engaged. A location system provided on the docking head and plate allows lowering of the docking plate into contact with the docking head with the result that all connections and mating surfaces are within 0.003 inch of their optimal location.

In view of the above, it is an object of the invention to provide a docking head and plate capable of quickly engaging and disengaging multiple service connections.

It is another object of the invention to provide a docking head and plat having an interlock system to prevent accidental lifting and damage to service connections.

It is yet another object of the invention to provide a docking head and plate having an automatic alignment system.

BRIEF DESCRIPTION OF THE DRAWINGS

For a further understanding of the nature and objects of the present invention, reference should be had to the following description taken in conjunction with the accompanying drawings in which like part are given like reference numerals and, wherein.

DETAILED DESCRIPTION OF THE PREFERRED EMBODIMENT

Figure 1:
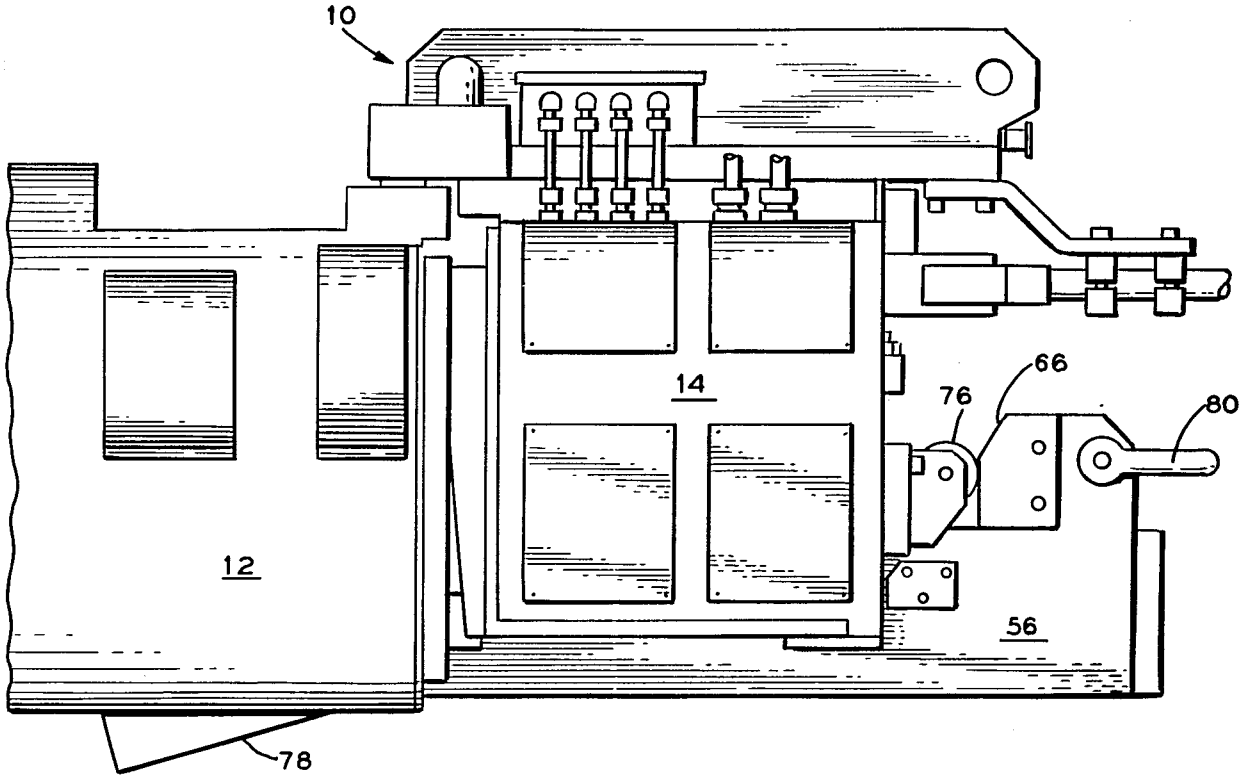
FIG. 1 is a side view of the docking head and plate.
Figure 2:
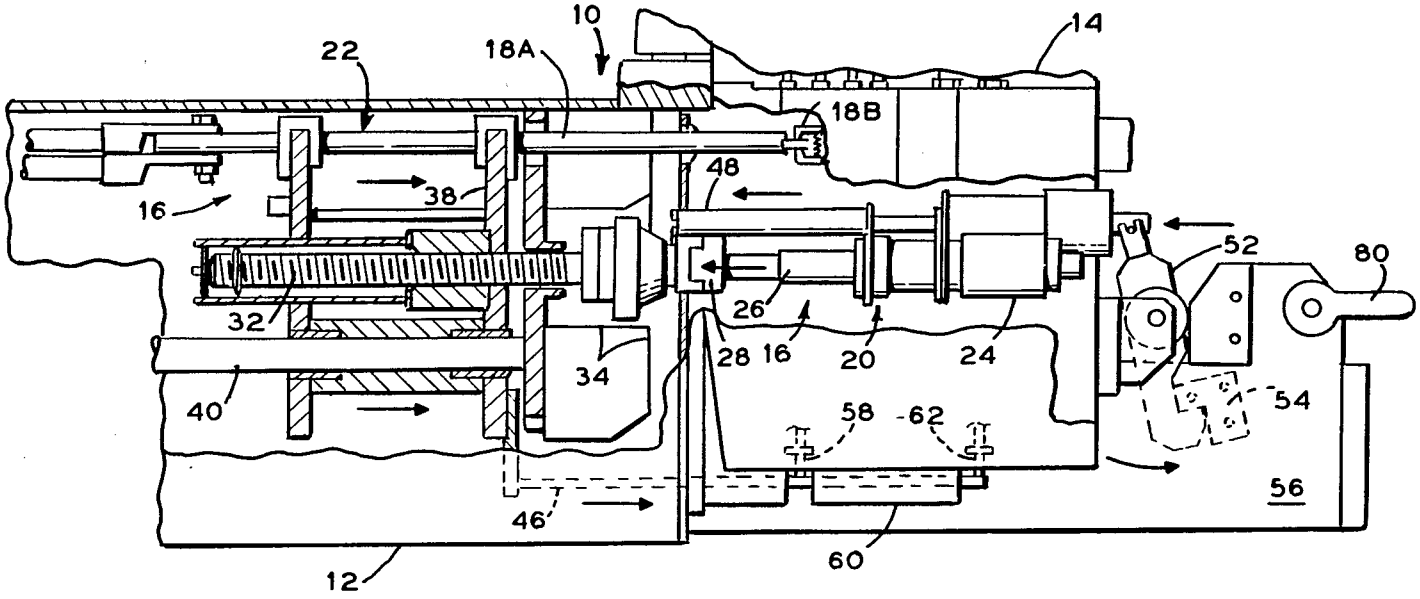
FIG. 2 is a partial cutaway view of the docking head and plate with their respective connections engaged.
Figure 3:
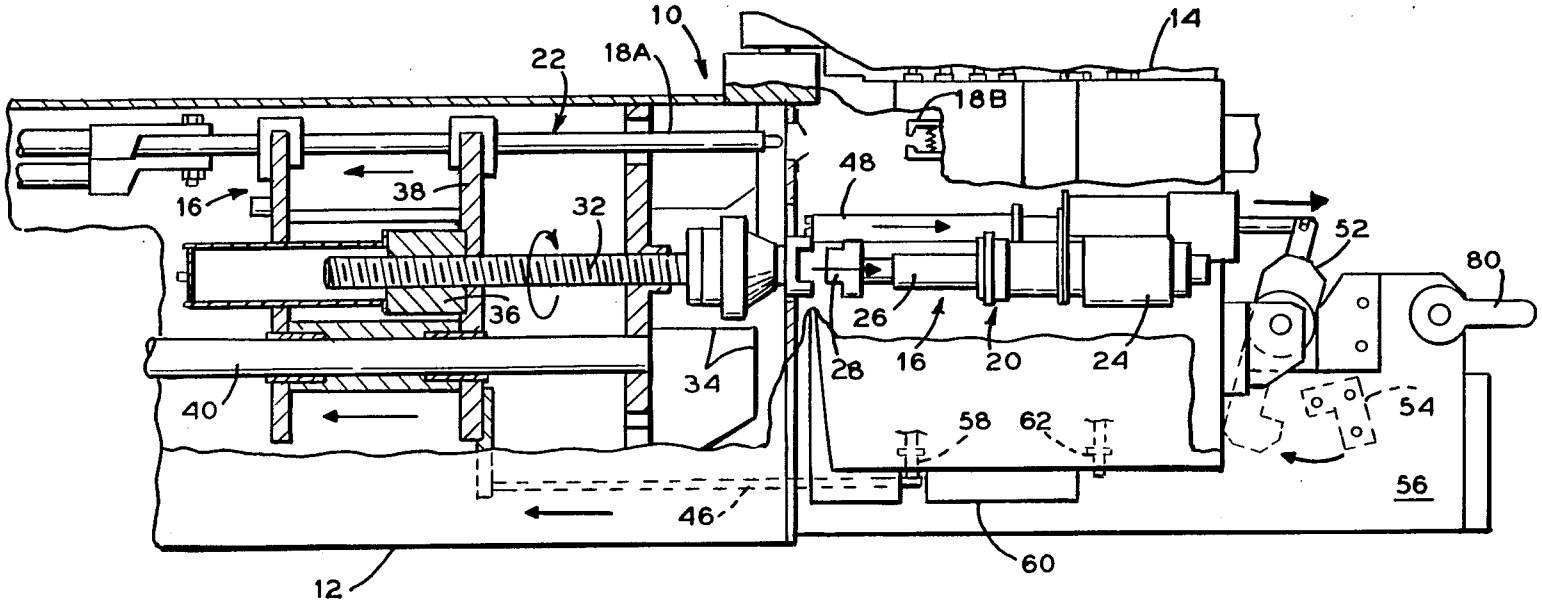
FIG. 3 is a partial cutaway view of the docking head and plate with their respective connections disengaged.

Referring now to the drawings, it can be seen in FIGS. 1–3 that the docking head and plate assembly is generally referred to by the numeral 10. Docking head 12 is the portion of equipment that fits inside of the new pipe section being added to the pipeline and is similar to equipment presently used in that electrical and hydraulic services received by docking head 12 are supplied to equipment not shown positioned further inside the pipeline through docking head 12. Services received by docking head 12 are received through docking plate 14. Instead of having service connections which must be manually and individually engaged and disengaged by trained personnel, means 16 for engaging and disengaging all service connections 18 between docking head 12 and docking plate 14 is provided. Engaging means 16 is generally comprised of drive assembly 20 and bushing plate assembly 22.

Drive assembly 20 is positioned in docking plate 14 as best seen in FIGS. 2 and 3. In the preferred embodiment, drive assembly 20 is comprised of an air motor 24 and drive shaft 26 which extends rearwardly of air motor 24 in docking plate 14. Upon actuation of air motor 24 to engage services, drive shaft 26 is caused to begin rotating and move rearwardly outward of docking plate 14 a predetermined distance so as to engage bushing plate assembly 22, as illustrated in FIG. 2. As seen in FIGS. 2 and 3, drive shaft 26 and bushing plate assembly 22 are provided with corresponding keyed ends 28, 30 respectively for transmission of rotational power from drive shaft 26 to bushing plate assembly 22. Keyed end 30 may be spring loaded to prevent damage when ends 28 and 30 are initially driven together.

It can be seen in bushing plate assembly 22 that keyed end 30 is attached to the forward end of screw drive 32. The forward end of screw drive 32 is rotatably mounted in stationary support plate 34 and adapted to rotatably engage with drive shaft 26. Nut 36 is threadably engaged adjacent the opposite or rearward end of screw drive 32 and is fixedly attached to bushing plate 38 or may be integral with bushing plate 38. This results in translational movement of bushing plate 38 within docking head 12 in response to rotation of screw drive 32, as illustrated by the arrows in FIGS. 2 and 3. One or more guide bars 40, with only one being shown for ease of illustration, may be attached to the lower portion of stationary support plate 34. Guide bar 40 is stationary within docking head 12 and serves to guide bushing plate 30 along a predetermined path either backwards or forward within docking head 12, depending on the direction of rotation of screw drive 32. The movement of bushing plate 38 forward or backward as indicated by arrows in FIGS. 2 and 3 respectively serves to cause engaging or disengaging of service connections 18. Male service connection 18*a* is connected to bushing plate 38 by clamp 42 so as to cause movement of connection 18 in conjunction with movement of bushing plate 38. In this manner, male connection 18*a* is caused to move exterior of docking head 12 into docking plate 14 and into engagement with female service connection 18*b* as illustrated in FIG. 2. As illustrated in FIG. 3, male connection 18*a* is caused to be disengaged from female connection 18*b* by being withdrawn back into docking head 12 upon opposite rotation of screw drive 32. Although only one service connection is shown for ease of illustration, it can been seen in FIGS. 4 and 5 that a plurality of corresponding ports 44 are provided on docking head 12 and docking plate 14 so that a variety of electrical and hydraulic services may be made available.

Figure 4:
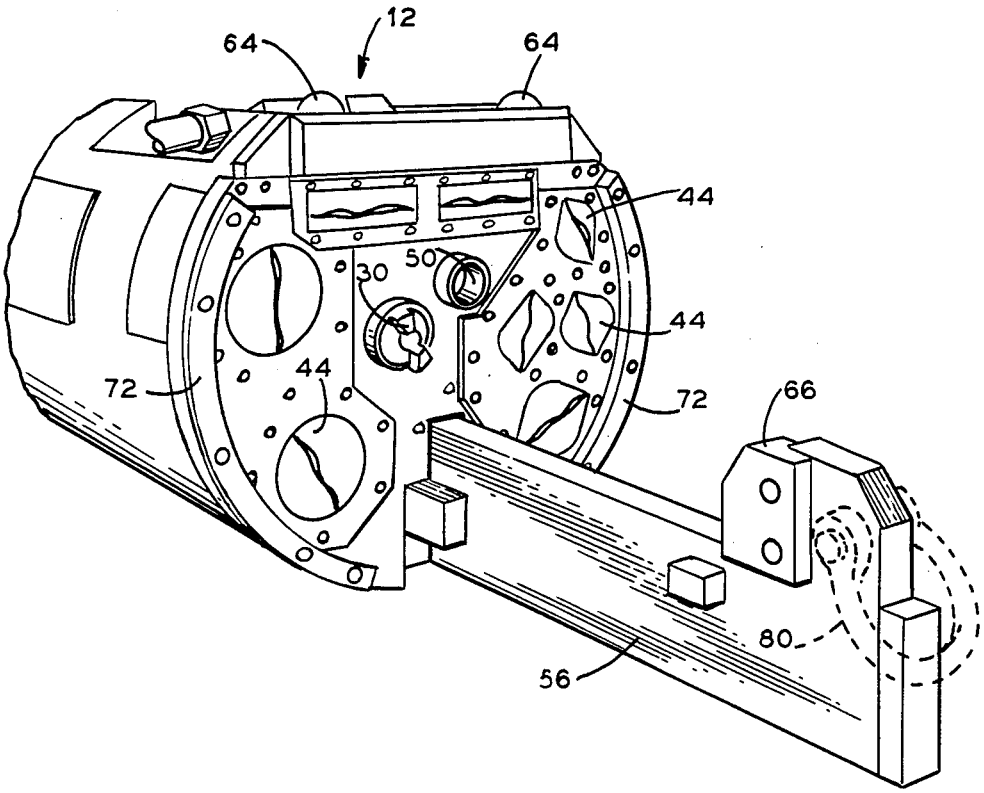
FIG. 4 is a perspective view of the docking head.
Figure 6:
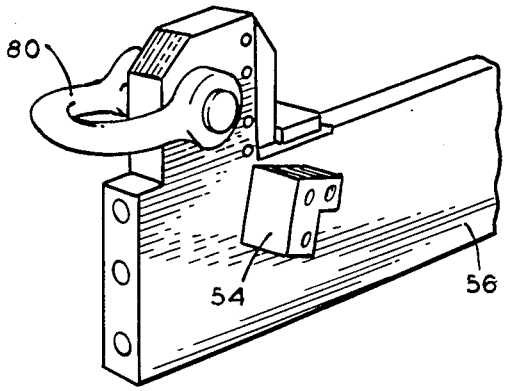
FIG. 6 is a view of a portion of the locking mechanism on the boom extending from the docking head.

Means for releasably interlocking docking plate 14 is position with docking head 12 is provided. As air motor 24 moves drive shaft 26 rearwardly to engage screw drive 32, it also moves locking pin 48 rearwardly as indicated by the arrow in FIG. 2. The rearward end of locking pin 48 moves exterior of docking plate 14 a predetermined distance and is received by pilot hole 50 in stationary support plate 34 of docking head 12. Pilot hole 50, best seen in FIG. 4, is in coaxial alignment with locking pin 48 when docking head 12 and docking plate 14 are properly positioned adjacent one another for connection of services. Latch 52 is pivotally attached to the forward end of docking plate 14 and in engagement with the forward end of locking pin 48 such that movement of locking pin 48 causes pivoting of latch 52. As seen in FIG. 2, rearward movement of locking pin 48 during connection of services causes pivoting of latch 52 and engagement of the lower portion thereof with catch 54. As seen in FIGS. 2, 3, and 6, catch 54 is substantially L-shaped and rigidly fastened to boom 56 which extends forward of docking head 12 and serves as a mounting platform for docking head 12 and docking plate 14. In this manner, docking plate 14 is locked in position as indicated in FIG. 2 to prevent inadvertent lifting of docking plate 14 and damage to service connections 18*a,b*. When it is desired to remove docking plate 14, air motor 24 is reversed, the service connections 18*a, b* are disengaged, and drive shaft 26 and locking pin 48 are caused to move forward within docking plate 14 as illustrated in FIG. 3. Docking plate 14 may then be lifted as locking pin 48 and latch 52 are then disengaged from pilot hole 50 and catch 54 respectively.

Proximity pin 46 extends forward of docking head 12 along one side of boom 56 as seen in FIGS. 2 and 3 and is movable between a first retracted position and a second extended position when service connections 18*a,b* are respectively disengaged and engaged. As seen in FIGS. 2 and 3, proximity pin 46 is moved into contact with first normally open proximity switch 58, through guide plate 60, and into contact with second normally closed proximity switch 58 when moving from its first retracted to its second extended position. When proximity pin 46 is advanced by bushing plate assembly 22 forward, it is directed through guide plate 60 so that it makes contact with and opens normally closed second proximity switch 62. The opening of switch 62 provides an indication that all service connections guided by bushing plate assembly 22 have been made and stops rotation of air motor 24 in that direction. However, it does not prevent air motor 24 from rotating in the opposite direction to cause uncoupling of the service connections and interlocking means between docking head 12 and docking plate 14. When air motor 24 is operated to cause such uncoupling, the movement of proximity switch 58 to open. This stops rotation of air motor 24 in that direction and indicates that the service connections and interlock system have been uncoupled and that docking plate 14 may be removed without damage.

Figure 5:
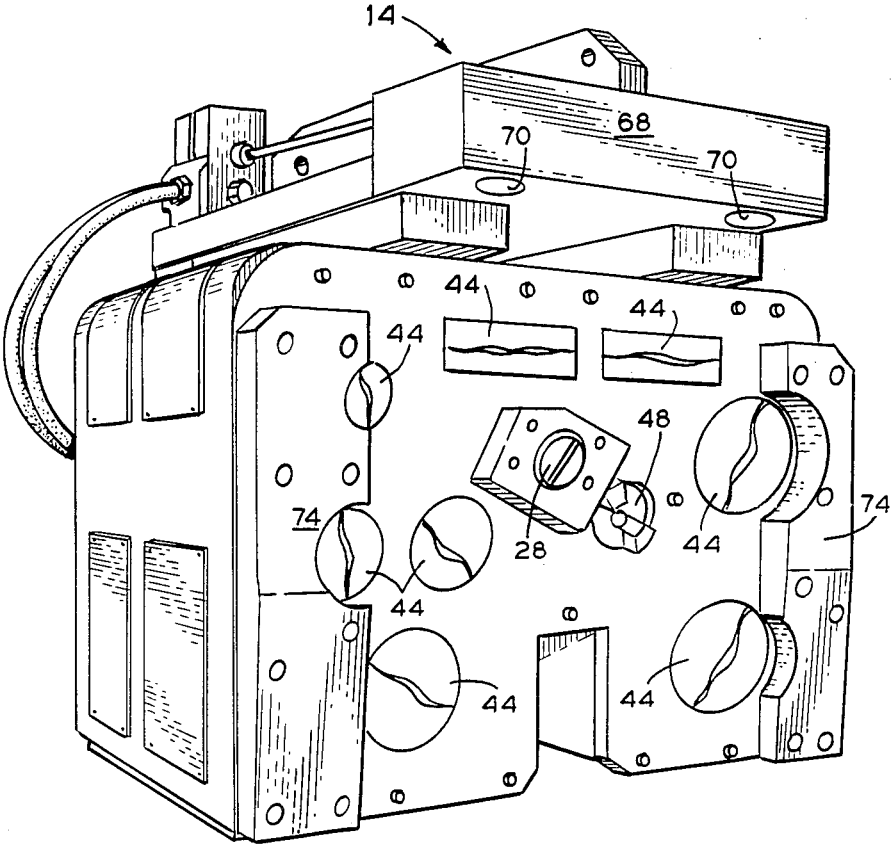
FIG. 5 is a perspective view of the docking plate.

Means for aligning docking plate 14 with docking head 12 is provided which causes all surfaces to be positioned within 0.003 inch of their optimal location. A three point system best seen in FIG. 4 is comprised of two balls 64 spaced across the top of docking head 12 adjacent its forward end and an inclined ramp 66 mounted adjacent the forward end of boom 56 and facing docking head 12. Docking plate 14 is provided with corresponding points. As best seen in FIG. 5, alignment plate 68 positioned substantially at the top of docking plate 14 extends rearwardly of docking plate 14 and is provided with two semicircular cutouts 70 adapted to receive balls 64. As balls 64 are received within cutouts 70, alignment between docking head 12 and docking plate 14 is substantially automatic as docking plate 14 is lowered into position by use of a crane. To ensure that vertical faces 72 and 74 of docking head 12 and docking plate 14 respectively are in contact, a wheel 76, best seen in FIG. 1, rotatably mounted at the forward end of docking plate 14 makes contact with ramp 66 and forces docking plate 14 toward docking head 12.

Means for preventing loss of the equipment in the pipeline being formed is provided in the form of machine stop 78 illustrated in FIG. 1 which is pivotally mounted at the bottom of docking head 12 and biased in a normally down position by a spring not shown. Machine stop 78 is spring loaded so as to allow addition of pipe sections to the pipeline being formed and faces rearwardly so as to prevent docking head 12 and boom 56 from sliding into the pipeline. Chain shackle 80 is fastened at the foward end of boom 56 to allow attachment to a winch or other such device as an additional safety measure for preventing loss of the equipment and for movement or removal of the equipment.

In operation, docking plate 14 is lowered into position and properly aligned with docking head 12 by alignment plate 68 and wheel 76. Air motor 24 is actuated which causes drive shaft 26 to begin rotating and move into contact with keyed end 30 of screw drive 32. Locking pin 48 is also moved into pilot hole 50 and latch 52 engages with catch 54 to lock docking plate 14 in position. Rotation of screw drive 32 causes movement of bushing plate 38 in docking head 12. Movable service connection 18*a* mounted on bushing plate 38 is caused to move into engagement with service connection 18*b* in docking plate 14. Air motor 24 is automatically stopped when proximity pin 46 opens proximity switch 62. Services are then available to equipment down line of docking head 12. The procedure is reversed when it is necessary to remove docking plate 14 so that a new section of pipe may be added. Connection and disconnection of services between docking head 12 and docking plate 14 are each accomplished in approximately 7.5 seconds.

Because many varying and differing embodiment may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed is:

1. A docking head and plate assembly, comprising:

a. a docking head having service connections for receiving and supplying services;

b. a docking plate removably engageable with said docking head and having service connections adapted for supplying services to said docking head; and c. means for engaging and disengaging said service connections between said docking head and docking plate, comprising:

i. an air motor and drive shaft positioned in said docking plate;

ii. a screw drive rotatably mounted in said docking head and adapted to rotatably engage with said drive shaft; and iii. a bushing plate threadably engaged on said screw drive for translational movement within said docking head in response to rotation of said screw drive.

2. The assembly of claim 1, further comprising means for aligning said docking plate with said docking head.

3. The assembly of claim 1, further comprising means for releasably interlocking said docking plate in position with said docking head.

4. The assembly of claim 1, further comprising means for preventing loss of said docking head.

5. A docking head and plate assembly, comprising:

a. a docking head having service connections for receiving and supplying services;

b. a docking plate removably engageable with said docking head and having service connections adapted to receive said service connections in said docking head for supplying services to said docking head;

c. means for engaging and disengaging said service connections between said docking head and said docking plate comprising a drive assembly in said docking plate and a bushing plate assembly in said docking head; and d. said bushing plate assembly comprising a screw drive rotatably mounted in said docking head and adapted to rotatably engage with said drive assembly and a bushing plate threadably engaged on said drive for translational movement with said docking head in response to rotation of said screw drive.

6. The assembly of claim 5, wherein said drive assembly comprises an air motor and drive shaft coupled to said air motor.

7. The assembly of claim 5, further comprising means for aligning said docking plate with said docking head.

8. The assembly of claim 5, further comprising means for releasably interlocking said docking plate in position with said docking head.

9. The assembly of claim 5, further comprising means for preventing loss of said docking head.

10. A docking head and plate assembly, comprising:

a. a docking head having movable service connections therein for receiving and supplying services;

b. a docking plate removably engageable with said docking head and having service connections adapted to receive said service connections in said docking head for supplying services to said docking head;

c. a drive assembly mounted in said docking plate;

d. a screw drive rotatably mounted in said docking head and adapted to rotatably engage with said drive assembly;

e. a bushing plate threadably engaged on said screw drive and having said movable service connections attached thereto for translational movement within said docking head in response to rotation of said screw drive;

f. means for aligning said docking plate with said docking head; and g. means for releasably interlocking said docking plate in position with said docking head.

11. The assembly of claim 10, wherein said drive assembly comprises an air motor and drive shaft coupled to said air motor.

12. The assembly of claim 10, wherein said aligning means comprises:

a. at least two balls positioned at the top forward end of said docking head;

b. an alignment plate attached at the top rear of said docking plate and adapted to receive said balls;

c. a boom extending forward of said docking plate and having an inclined ramp adjacent its forward end; and d. a wheel rotatably mounted at the forward end of said docking plate and positioned to be in rolling contact with said ramp, whereby said docking plate is forced toward said docking head.

13. The assembly of claim 10, wherein said interlocking means comprises:

a. a locking pin in said docking plate movable between a first retracted position and a second extended position exterior of said docking plate;

b. a support plate in said docking head having a pilot hole adapted to receive said locking pin;

c. a latch attached to one end of said locking pin and pivotally mounted on said docking plate so as to be movable between a first unlatched and a second latched position; and d. a catch mounted on a boom extending from said docking head and adapted to engage said latch in response to movement of said latch into said second latched position.

* * * * *